United States Patent [19]

Stary et al.

[11] Patent Number: 5,017,034

[45] Date of Patent: May 21, 1991

[54] MARKER AND PEN COMBINATION EMPLOYING TRANSVERSE AND LONGITUDINALLY SPACED TIPS

[76] Inventors: Jeffrey D. Stary, 2523 Marsh Dr., San Ramon, Calif. 94583; Victor H. Goulter, 485 Molimo Dr., San Francisco, Calif. 94127

[21] Appl. No.: 500,705

[22] Filed: Mar. 28, 1990

[51] Int. Cl.[5] ..... B43K 27/08

[52] U.S. Cl. ..... 401/35; 401/17

[58] Field of Search ..... 401/34, 35, 28, 17, 401/30, 31, 29, 20, 21

[56] References Cited

U.S. PATENT DOCUMENTS

| | | | |
|---|---|---|---|
| 2,554,335 | 5/1951 | Kollsman | 401/35 |
| 2,608,953 | 9/1952 | Kollsman | 401/35 |
| 3,079,895 | 3/1963 | Gordon | 401/35 |
| 3,887,287 | 6/1975 | Rosh | 401/35 |
| 4,580,918 | 4/1986 | Baker | 401/20 |
| 4,826,338 | 5/1989 | Kilpatrick | 401/35 |

FOREIGN PATENT DOCUMENTS

| | | | |
|---|---|---|---|
| 3342648 | 6/1985 | Fed. Rep. of Germany | 401/35 |
| 475483 | 10/1952 | Italy | 401/35 |

*Primary Examiner*—Richard J. Johnson

[57] ABSTRACT

A writing instrument comprises a combined marking pen and a fine line pen, especially useful for providing a highlighter and an underliner or a note writer. It comprises a single elongated body (23) with a felt marking pen tip (25A) and a ballpoint pen tip (27A), both projecting from the bottom end of the body. The ends of the tips are spaced apart in the longitudinal direction of the body and in a second direction perpendicular to the longitudinal direction. This enables a user to write with either tip by holding the pen at either of two angles to the vertical. The spacing in the second direction can be effected, even if the felt body and the ballpoint cartridge are adjoining, by providing a cutout (24) in the felt tip adjacent the ball point tip. The pen can include two ballpoint tips (57A, 57B), spaced from the marker's tip in the second direction, but aligned in the longitudinal direction. The body can include a dividing partition (64) to separate the ballpoint cartridge from the felt pen's reservoir.

20 Claims, 3 Drawing Sheets

31
33
35
23

23
31
33
35

25B
33
37
35
25

27B
39
7
7
23
33
31
6
6
5
5
29
29
27B
37
41
4
4
27A
24
25A

23

21
23

29
29
27A
25A
27A
25A

FIG 8
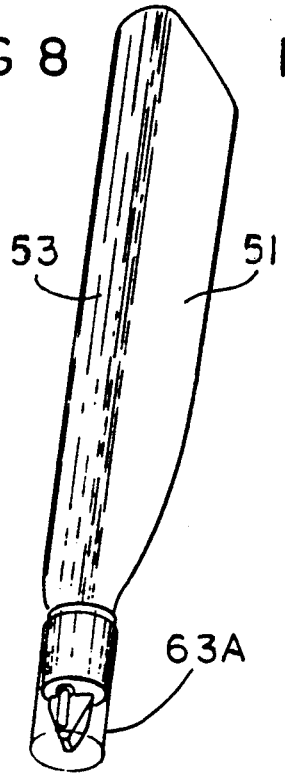
FIG 9
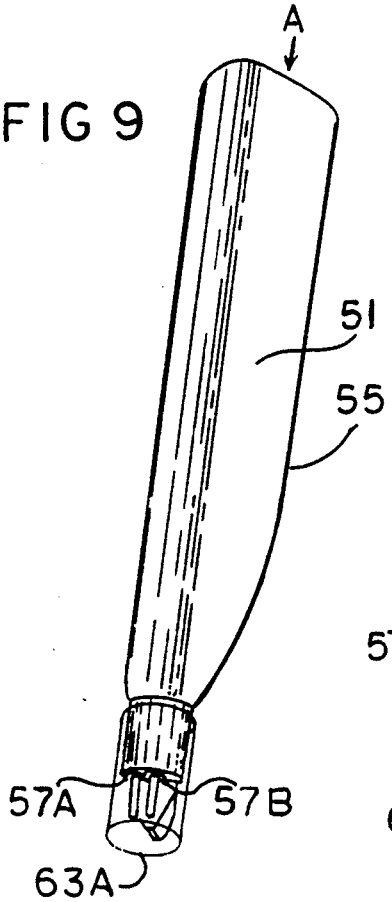
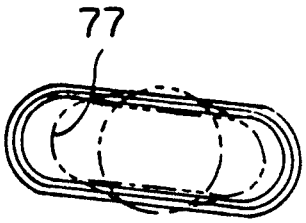
FIG 11
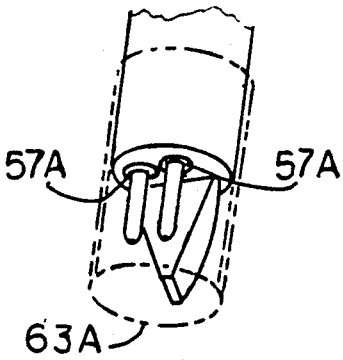
FIG 10A
FIG 10B
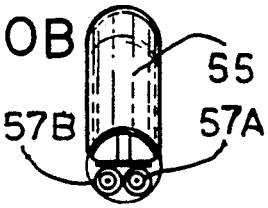
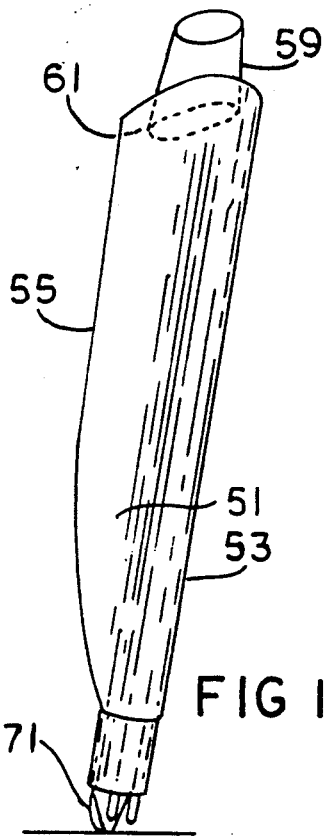
FIG 12
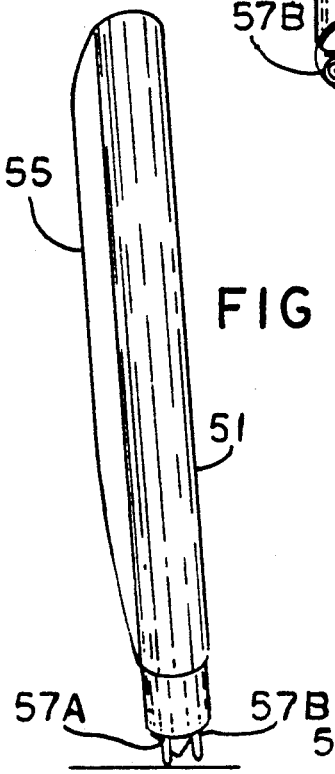
FIG 13
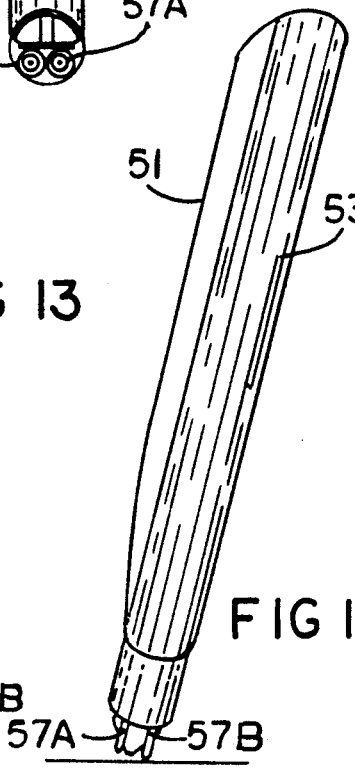
FIG 14

MARKER AND PEN COMBINATION EMPLOYING TRANSVERSE AND LONGITUDINALLY SPACED TIPS

BACKGROUND

1. Field of Invention

The present invention relates to writing instruments, specifically to wide line and fine line pens.

2. Field of Prior Art

Recently wide-line pens have become popular. Usually these have a felt tip for writing a wide to broad line, usually from 2 to 5 mm. When such pens are filled with a light ink, such as yellow or light green, they can be used to write over selected typed or printed words in a document or printed material in order to emphasize or highlight such words without obscuring them. In this case such pens are known as "highlighters".

Frequently writers, students, researchers and others need to use a highlighter and a fine-line pen alternately, e.g. to mark important passages in a document and make notes in a notebook in an alternate manner. One problem with using two different pens is that this means putting down the highlighter, then picking up a ballpoint pen, underlining, then putting down the pen and picking up the highlighter and proceeding to highlight until the next stronger emphasis needs to be done, then once again putting down the highlighter and taking up the ballpoint pen again etc.

When many papers are to be done, this process is both time consuming and frustrating. This problem cannot be overcome by using a highlighter in one hand and a pen in the other because both hands are not trained to use a pen or marker Also if the notebook page is conveniently placed for only one hand, it would have to be moved to a different position for the other hand. Another problem is that when a user finds it desirable to further emphasize words that have already been highlighted, the line drawn under the word is frequently untidy and also not parallel. Sometimes these two lines lack proper spacing.

Further problems exist where people desire to use three pens, such as a highlighter, a black pen, and a red pen The purpose of the red pen is to further emphasize the most important parts. Using three single pens entails very frequent putting down and picking up, and is most inconvenient.

Alternatively one could use one pen having multiple inserts, together with a highlighter, but again much time is lost in thumbing down the correct color, so that this is hardly better than using three separate pens.

Whatever combination of pens is used, the result is a constant putting down and picking up process. Also multiple-point pens alone are not the answer as the accepted practice is to highlight words and phrases and it is still awkward to withdraw one point and then push out the other, an inconvenient, slow and interruptive operation.

Markers and fineline pens have been combined in one housing, with the marker at one end and a fineline pen at the other. However it is not convenient to turn the instrument over to switch pens. Also two caps are required; these can be lost and it is inconvenient to recap a single pen twice.

OBJECTS AND ADVANTAGES

Accordingly, several objects and advantages of the present invention are to provide a pen which can highlight and underscore with fine lines in a quick convenient, and easy-to-use manner which does not require putting down and picking up different pens, turning a pen over, etc Other objects and advantages are to provide a convenient highlighter and a fine-line pen combination, and to provide a highlighter and fine-line pen combination in which switching from one point to another can be done instantly. Further objects and advantages are to provide a highlighter and fine-line pen combination in which the user can use the highlighter, or the fine-line separately or even together, so as to make two lines similtanously, to provide a highlighter and two fine-line pens of different colors, to provide a highlighter and two fine-line pens, any one of which can be used independently of the other, or two fine-line pens can be used together independently of the third Pen, or even three points could be used together, if required, to provide a pen combination in which all three pen points can be capped with just one cap, to provide a pen combination in which a minimum of effort is required to accomplish a large variety of highlighting and marking alternatives, and to provide a pen combination which incorporates all of the required points to sucessfully mark even the most complicated article. Still a further object and advantage is to provide a unit which saves time and frustration, which in itself enables a user to concentrate more on studies or research. A further object is to provide an instrument which overcomes the need to put a marker down, then pick up a Pen, then reverse the proceedure over and over again in order to accomplish a properly marked article. Still further objects and advantages will be apparent from a consideration of the ensuing description and accompanying drawings.

BRIEF DESCRIPTION OF DRAWINGS

FIG. 8 is a perspective view to a marker and pen combination with an alternative body design.

FIG. 9 is a perspective view of a combined marker and two fine-line pens.

FIG. 10A is an enlarged perspective view of the point of the instrument of FIG. 9

FIG. 10B is a perspective ene view of the instrument of FIG. 9.

FIG. 11 is an enlarged end view taken in the direction of arrow A of FIG. 9

FIG. 12 is a perspective view of the instrument of FIG. 9 with its protective cap removed and the instrument oriented to perform as a highlighter.

FIG. 13 is a perspective view of the instrument of FIG. 9 oriented to write in black.

FIG. 14 is a perspective view of the instrument of FIG. 9 oriented to write in red.

REFERENCE NUMERALS

Figures 1, 2, 3, 4, 5, 6, 7:
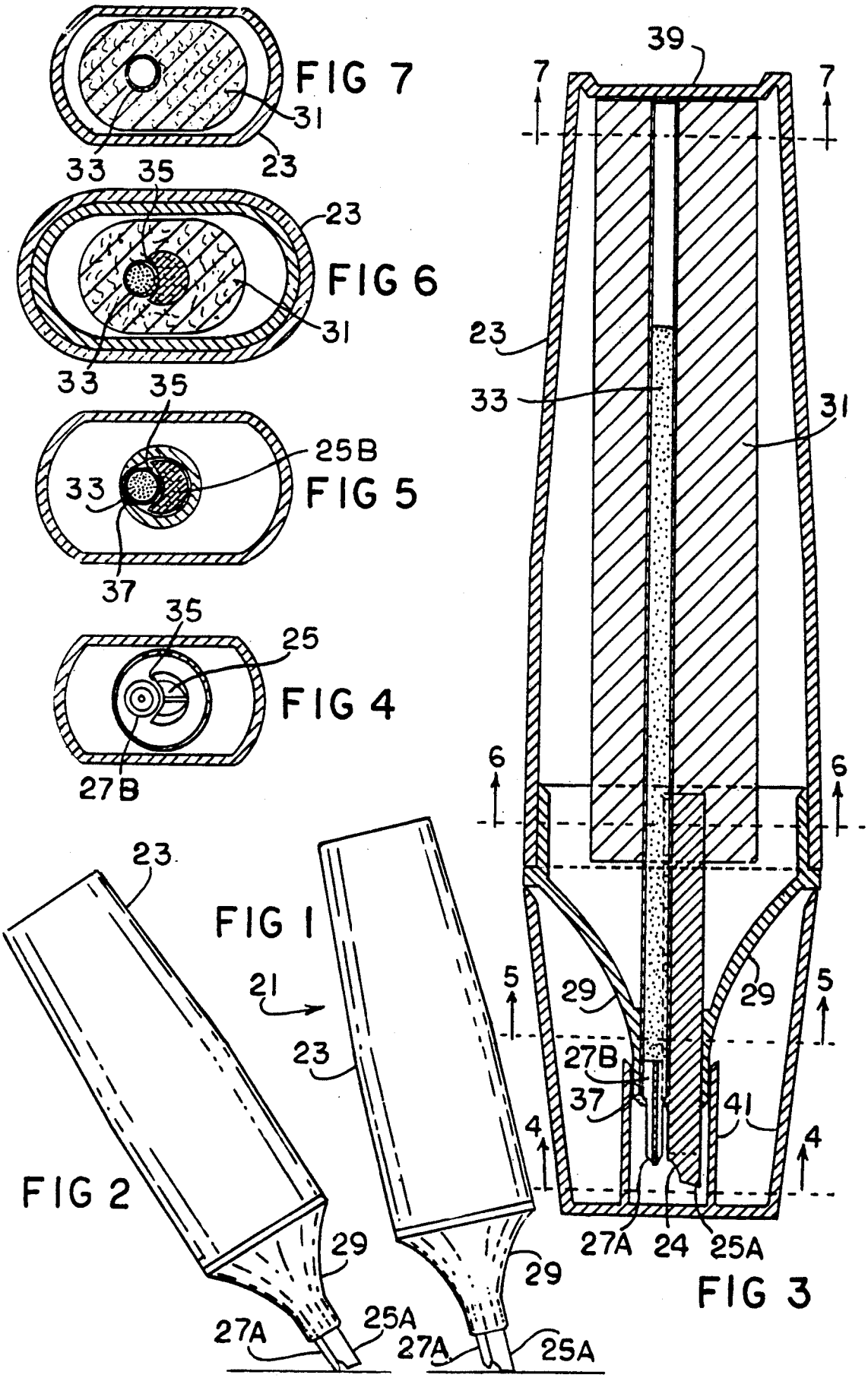
FIG. 1 is a perspective side view of a combined marking and ballpoint pen in accordance with the invention.
FIG. 2 is a perspective side view of the instrument of FIG. 1 used at a lower angle.
FIG. 3 is a sectional side view of the instrument of FIG. 1.
FIG. 4 to 7 are sectional views taken along the lines 4—4 to 7—7 of FIG. 3.

21 marker pen 23 marker body
24 cutout portion
25A felt point
25B marker felt
27A ballpoint pen
27B ballpoint insert
29 tapered portion
31 resevoir
33 ink tube
35 cut-away section
37 channel
39 end cap
41 protective cover
51 housing
53 straight side
55 curved side
57A and 57B black and red pens
59 cap
61 recess
62 end cap
63A flat top
63B domed top
64 dividing wall
64' extended wall
65 resevoir
67 cavity
69A and 69B ink tubes
71 marker tip
73A and 73B pen points
75 wick
76 elongated shape
77 sharpened end
79 throat
81 rounded side
85 metal insert
87 aperture

DETAILED DESCRIPTION OF THE PREFERRED EMBODIMENT—FIGS. 1, 3 and 6

FIG. 1 shows a combined marker and fine-line pen 21. It comprises a body 23, a felt point 25A, and a ballpoint 27A. Body 23 is relatively thick. A tapered portion 29 is joined to body 23 and tapers down to a narrow tip from which points 25A and 27A project. Point 25A has a rectangular cross section about 4 mm by 2 mm and projects out about 7 mm from the narrow bottom of tapered portion 29. Ballpoint 27A projects about 6 mm. The side of point 25A adjacent point 27A has a cutout portion 24 so that the tip of point 27A projects free of point 25A.

To use the instrument as a highlighter, the user holds the instrument more vertically as shown, so that felt point 25A, but not ballpoint 27A, contacts the paper. To use the instrument as a fine-line pen, body 23 is angled downward as shown in FIG. 2 so as to enable the instrument's ballpoint 27A, but not point 25A, to contact the paper.

FIG. 3 shows a cross-sectional view of the instrument of FIG. 1. Marker felt 25B extends into body of the marker where it is partly immersed in a cotton packing wad resevoir 31 which is saturated with marker ink.

A ballpoint pen ink tube 33 and ballpoint tip or insert portion 27B are positioned in a cutaway section 35 (FIGS. 4 to 6) of felt 25B'. Tube 33 is secured tightly between felt stem 25B and a hollowed-out channel 37 of tapered portion 29. Ink tube 33 extends through resevoir 31 and rests against an end cap 39 (FIG. 3). Protective cover 41 fits over both points 25A and 27A. The top end of ink tube 33 is normally empty (FIGS. 3 and 7) so that its ink will not mix with and contaminate the marker ink in resevoir 31. Tube 33 is held in a straight position by reservoir 31.

PREFERRED BODY DESIGN—FIGS. 8-20

FIG. 8 shows a combination instrument with a more ergonomic body design. A housing 51 has one straight side 53 and one curved side 55. This design provides space for fitting one or two ballpoint pens 57A and 57B (FIGS. 9-20) One pen can be black ink and the other red (shown more clearly in FIG. 10A)

Cap 59 can be made of a pliable plastic, such as polypropylene or any other suitable material. After the cap is removed and while the instrument is in use it can be fitted into recess 61 of end caP 62, best seen in FIGS. 12, 15, and 20. Cap 59 can be made with a flat top 63A (FIGS. 8, 9, and 10) or a dome-shaped top 63B (FIG. 15).

Figure 15:
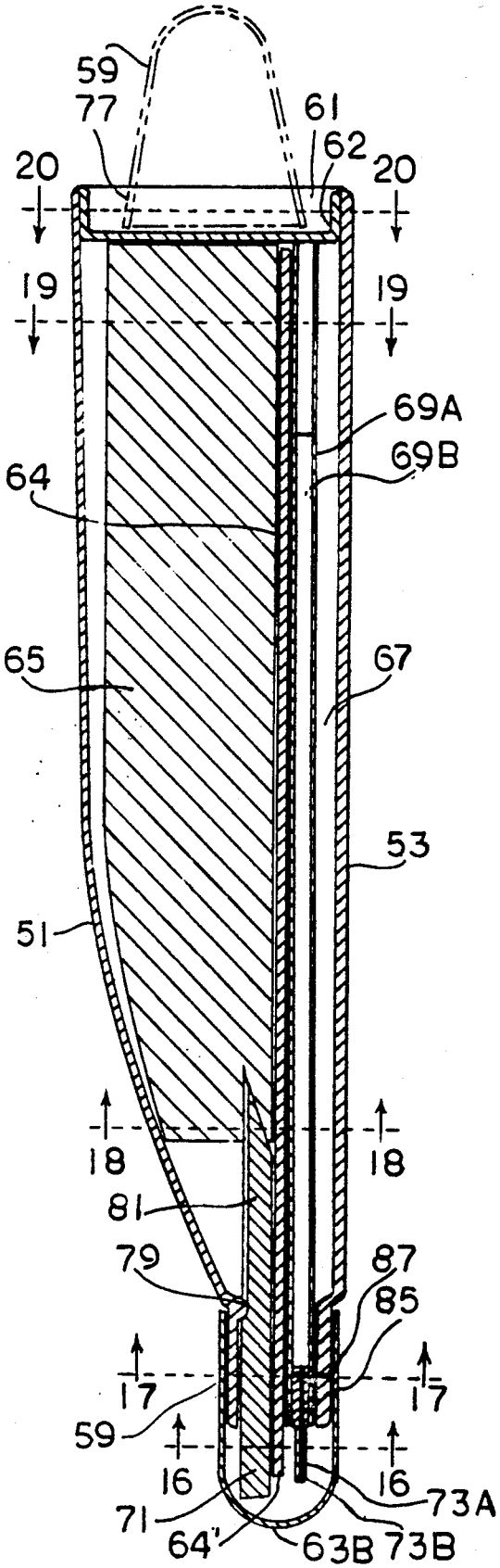
FIG. 15 is a sectional view of the instrument of FIG. 9.
Figure 20:
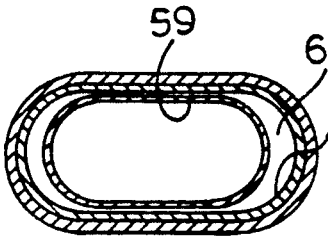
FIGS. 16 to 20 are a sectional views taken along the lines 16—16 to 20—20, respectively, of FIG. 15.
Figure 19:
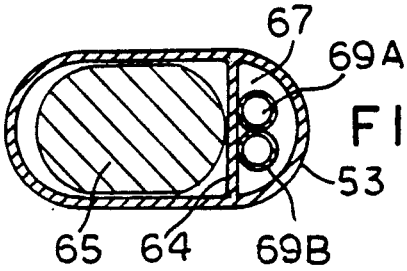
Figure 18:
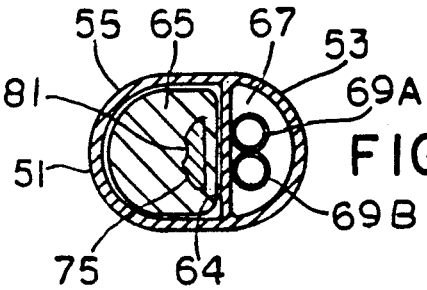
Figure 16:
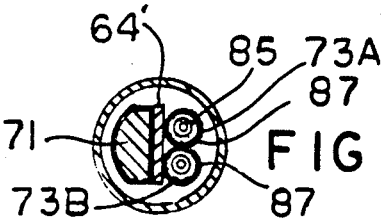

The pen may have a dividing wall 64 as shown in FIGS. 15, 16, 18, and 19. This wall is integral with and extends for the full length of housing 51. It separates marker ink resevoir 65 from cavity 67 in which two pen ink tubes 69A and 69B are housed (FIGS. 15, 18, and 19). Wall 64 also extends toward the tip of the instrument to form an extended wall 64' between marker tip 71 and pen points 73A and 73B (FIGS. 15 and 16).

Alternatively, cavity 67 may be used as a resevoir for an ink supply for the felt tip pens used instead of ballpoint pens. The supply of ink for a felt tip fine-line pen is similiar to the supply of ink for a wide highlighting pen, in that a wad is soaked with ink and delivers ink to a fine felt tip by capillar action. Dividing wall extension 64' (FIGS. 15 and 16) prevents the pen and marker tips coming into contact with each other and causing color mixing.

Marker wick 75 extends inward and has a sharpened end 77 which pierces ink resevoir 65 to a depth of about 13 mm (.5 in) when it is fully inserted (FIGS. 15 and 18). The purpose of this penetration is to collect ink from resevoir 65 by capillary action. A throat 79 (FIGS. 15 and 17) has a narrow section which jams against rounded side 81 of wick 75 when the wick is inserted and prevents it from slipping further in under pressure from normal use.

Figure 17:
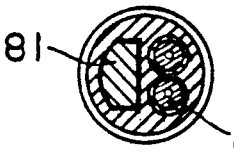

FIG. 15 and 16 shows pen points 73A and 73B protruding beyond the end of housing 55 about 6.5 mm (0.25 in) and marker tip 71 protruding about 2 mm beyond the pen's tip. The pen's metal insert 85 is made of sufficient thickness to be a press fit into instrument body aperture 87 (FIGS. 15 and 17). Ink tubes 69A and 69B are of sufficient length to abut against end cap 62 when fully inserted.

FIG. 19 shows ink resevoir 65 separated by wall 64 from ink tubes 69A and 69B.

OPERATION

In use, either the marker or the fine-line pen can be used separately. If the instrument has two fine-line pens, either fineline pen or marker can be used independently.

When the instrument has one fine-line and a marker, to use the marker alone the user orients the instrument's body more vertically to about 75 degrees from horizontal, as shown in FIG. 1, and writes with the instrument at this angle. In this position, fine-line point 27A, which protrudes less from the instrument's body than tip 25A and which is spaced horizontally from tip 25A, will be held away from the paper and will not contact it or mark it. To use the fine-line alone, the user lowers the instrument's body to about 60 to 65 degrees from the horizontal as shown in FIG. 2.

In this position fine-line point 27A will contact the paper, but tip 25A will be held clear of the paper due to the 60 to 65 degree angle of the instrument. To use marker and fine-line pens together, the user orients the instruments body at an angle of about 70 degrees (not shown) so that they both contact the paper at the same time.

When the pen has two fine-line pens and a marker to use the marker the user holds the body as before, about 75 degrees from horizontal. To use either fine-line pen the user lowers it about 60 to 65 degrees from horizontal and also rotates the instrument counterclockwise about 15 to 20 degrees to write with black ink tip, or clockwise 15 to 20 degrees to write with red ink. By carefully orienting the pen's body, all three points can be made to contact the paper at the same time.

Cap 59 can be removed by using a slight "twist-while-pulling" movement. Cap 59 can easily be fitted into end cavity 61 by pressing the open end into an elongated shape 76 (FIGS. 11, 15 and 20) before inserting it into cavity 61, then releasing finger and thumb pressure.

SUMMARY, RAMIFICATIONS, AND SCOPE

Thus, the reader will see that the combined marker and fine-line pen has many advantages over prior pens. I.e., when highlighting the user can highlight with a marker, underline with red ink, and write notes in a margin with black ink, all while using just one pen. He or she can save precious time previously wasted in turning over a pen to use alternate tips or picking up one Pen, putting down a marker, picking up another pen, putting down a pen picking up a marker, etc. The present pen will also save frustration, therefore Providing an atmosphere wherein more concentration can be directed toward obtaining information, rather than wasting time and effort.

Furthermore, for convenience, only one pen need be purchased, carried, and used, instead of the usual three. This also saves expense.

While the above description contains many specificities, the reader should not construe these as limitations on the scope of the invention, but merely as exemplifications of preferred embodiments thereof. Those skilled in the art will envision that many other possible variations are within its scope. For example, skilled artisans will readily be able to change the dimensions and shapes of the various embodiments, such as by making the instrument's body longer, wider, shorter, thicker, or narrower, or even to add finger grip indents and or protrusions to the external surfaces of the instrument. It is even possible to attach gripable materials to the outside surface of the instrument to facilitate easier grasping the instrument for writing. Also, it is possible to replace the fine-line pen with an automatic pencil or a retractable Pen, three or more pens, or more than one marker The two pens can be provided in two different housings which are glued, attached to form a single pen body, e.g., they can be welded, or snapped together, or the fine-line pen can simply be a ballpoint cartridge which is snapped into a longitudinal recess in the marking instrument's side, or is glued to the side of the marking pen. In lieu of a wide-line and fine-line pens, the two pens can be two inline pens of different colors, or a pencil and a fine-line pen. In lieu of spacing the marker and fine-line pen tips apart in two directions, i.e., in the directions of the instrument's longitudinal axis and in a perpendicular direction, they can be positioned without any longitudinal direction spacing, i.e with equal projections from the instruments body, so that they are separated solely in the perpendicular direction. In this case the user can use the fine-line pen alone in the same manner as before and the marker alone by holding the instrument at the same angle but rotating it 180 degrees.

Accordingly, the reader is requested to determine the scope of the invention by the appended claims and their legal equivalents, and not by the examples which have been given.

We claim:

1. A writing instrument which a user can use to write with either or both of two different marking lines, comprising:

an elongated body, said body having a longitudinal axis, and a pair of writing tips projecting from an end of said body, the ends of said tips being spaced apart in a transverse direction perpendicular to said axis and in a longitudinal direction parallel to said axis, said tips being elongated and parallel to each other, said tips being continuations of respective body portions within said housing which are also elongated and parallel to each other, and each body portion being coaxial with its respective tip whereby said user can write with either of said tips by holding said elongated body at either of two different angles tilted toward user's body, and can use said pen to write double lines which are parallel to the front of said user's body by holding said elongated body at a comfortable and customary angle tilted toward said user's body and at an acute angle to a writing surface.

2. The writing instrument of claim 1 wherein said pair of tips comprise a marking pen tip which is arranged to write with a relatively thick line and a fine-line pen tip which is arranged to write with a relatively fine line.

3. The writing instrument of claim 2 wherein said marking pen tip comprises a wick body with a relatively broad tip which has a cutout section adjacent said fine-line pen tip.

4. The writing instrument of claim 2 wherein said marking pen and fine-line pen tips are attached to respective elongated ink-holding bodies which are connected to said tips and which are oriented in said longitudinal direction as part of said body.

5. The writing instrument of claim 4 wherein said body comprises a housing, said ink-holding bodies being contained within said housing.

6. The writing instrument of claim 5 wherein said ink-holding body which is connected to said marking pen tip comprises a porous reservoir and said ink-holding body which is connected to said fine-line pen tip comprises a ballpoint pen cylinder, and further including a partition wall separating said cylinder from said porous reservoir.

7. The instrument of claim 1, further including a third tip, said third tip being spaced from each of said pair of tips in said transverse direction.

8. The instrument of claim 7 wherein said third tip and one of said first-named tips are arranged to write with relatively fine lines and wherein the other of said first-named tips is arranged to write with a relatively thick line.

9. The writing instrument of claim 8 wherein said other of said first-named tips comprises a wick body with a relatively broad tip which has a cutout section adjacent said fine-line pen tip.

10. The instrument of claim 9 wherein said wick body extends into said elongated body and has a longitudinal recess therein, said fine-line pen tip being connected to an elongated tubular ink reservoir in said body and positioned within said longitudinal recess in said wick body.

11. The instrument of claim 1, further including a cap arranged to cover said pair of tips, and means for removably attaching said cap to said pen body so that it covers said tips.

12. The writing instrument of claim 1 wherein said body has an elongated cross section when seen in said longitudinal direction.

13. A writing instrument which a user can use to write with either or both of two different marking lines, comprising:

an elongated body, said body having a longitudinal axis, and a pair of writing tips projecting from an end of said body, the ends of said tips being spaced apart in a transverse direction perpendicular to said axis and in a longitudinal direction parallel to said axis, said tips being elongated and parallel to each other, said tips being continuations of respective body portions within said housing which are also elongated and parallel to each other, and each body portion being coaxial with its respective tip whereby said user can write with either of said tips by holding said elongated body at either of two different angles tilted toward said user's body, and can use said writing instrument to write double lines which are parallel to the front of said user's body while holding said elongated body at a comfortable and customary angle tilted toward said user's body and at an acute angle to a writing surface.

14. The writing instrument of claim 13 wherein said pair of tips comprise a marking pen tip which is arranged to write with a relatively thick line and a fine-line pen tip which is arranged to write with a relatively fine line.

15. The writing instrument of claim 14 wherein said marking pen tip comprises a wick body with a relatively broad tip which has a cutout section adjacent said fine-line pen tip.

16. The writing instrument of claim 15 wherein said body comprises a housing, said ink-holding bodies being contained withing said housing.

17. The writing instrument of claim 16 wherein said ink-holding body which is connected to said marking pen tip comprises a porous reservoir and said ink-holding bodies which is connected to said fine-line pen tip comprises a ballpoint pen cylinder, and further including a partition wall separating said cylinder from said porous reservoir.

18. The instrument of claim 13, further including a third tip, said third tip being spaced from each of said pair of tips in said transverse direction.

19. The instrument of claim 18 wherein said third tip and one of said first-named tips are arranged to write with relatively fine lines and wherein the other of said first-named tips is arranged to write with a relatively thick line.

20. The writing instrument of claim 19 wherein said other of said first-named tips comprises a wick body with a relatively broad tip which has a cutout section adjacent said fine-line pen tip.

* * * * *